US011471021B2

(12) United States Patent
Zorzo

(10) Patent No.: US 11,471,021 B2
(45) Date of Patent: Oct. 18, 2022

(54) BASE OF A MOP COMPRISING AN ANTI-WITHDRAWAL DEVICE AND A CLEANING CLOTH

(71) Applicant: TTS CLEANING S.R.L., S. Giustina in Colle (IT)

(72) Inventor: Marco Zorzo, S. Giustina in Colle (IT)

( * ) Notice: Subject to any disclaimer, the term of this patent is extended or adjusted under 35 U.S.C. 154(b) by 0 days.

(21) Appl. No.: 17/054,034

(22) PCT Filed: May 6, 2019

(86) PCT No.: PCT/IB2019/053671

§ 371 (c)(1),
(2) Date: Nov. 9, 2020

(87) PCT Pub. No.: WO2019/215569

PCT Pub. Date: Nov. 14, 2019

(65) Prior Publication Data

US 2021/0228053 A1 Jul. 29, 2021

(30) Foreign Application Priority Data

May 8, 2018 (IT) ..... 102018000005169

(51) Int. Cl.
*A47L 13/256* (2006.01)
*A47L 13/44* (2006.01)

(52) U.S. Cl.
CPC ..... *A47L 13/256* (2013.01); *A47L 13/44* (2013.01)

(58) Field of Classification Search
CPC ..... A47L 13/256; A47L 13/20; A47L 13/24; A47L 13/254; A47L 13/44; A47L 13/46
USPC ..... 15/228, 231, 147.1, 147.2
See application file for complete search history.

(56) References Cited

U.S. PATENT DOCUMENTS

| | | | | |
|---|---|---|---|---|
| 1,256,989 | A * | 2/1918 | Duncan | A47L 13/20 15/228 |
| 4,225,998 | A * | 10/1980 | Thielen | A47L 13/256 15/231 |
| 5,926,896 | A * | 7/1999 | Allemann | A47L 13/258 15/147.2 |
| 7,191,486 | B1 | 3/2007 | Michelson et al. | |
| 9,226,638 | B2 * | 1/2016 | Zeng | A47L 13/258 |
| 9,820,628 | B2 * | 11/2017 | Zorzo | A47L 13/258 |
| 10,028,634 | B1 * | 7/2018 | Calderon | A47L 13/258 |
| 2015/0059113 | A1 * | 3/2015 | Zorzo | A47L 13/16 15/231 |

FOREIGN PATENT DOCUMENTS

| | | | |
|---|---|---|---|
| EP | 0370698 | A1 | 5/1990 |
| WO | 2011131820 | A1 | 10/2011 |
| WO | 2013153503 | A1 | 10/2013 |
| WO | 2015077422 | A2 | 5/2015 |

* cited by examiner

*Primary Examiner* — Orlando E Aviles
*Assistant Examiner* — Robert F Neibaur
(74) *Attorney, Agent, or Firm* — Quickpatents, LLC; Kevin Prince

(57) ABSTRACT

An anti-detachment device for the tabs for a cleaning cloth is associated with the relative base which is able to ensure they remain in place during the relative cleaning operations.

18 Claims, 3 Drawing Sheets

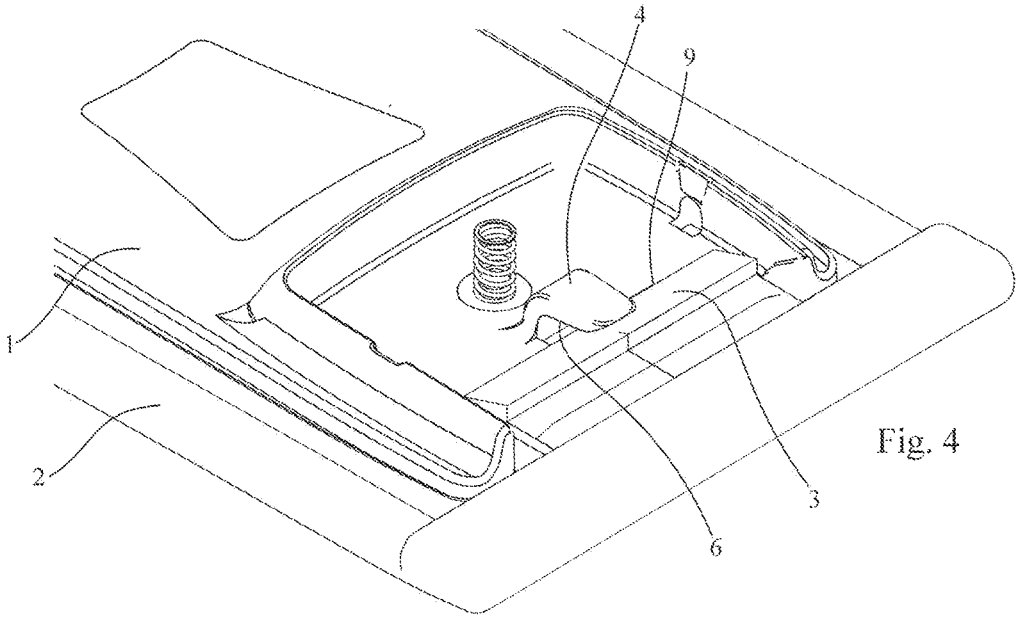
Fig. 4
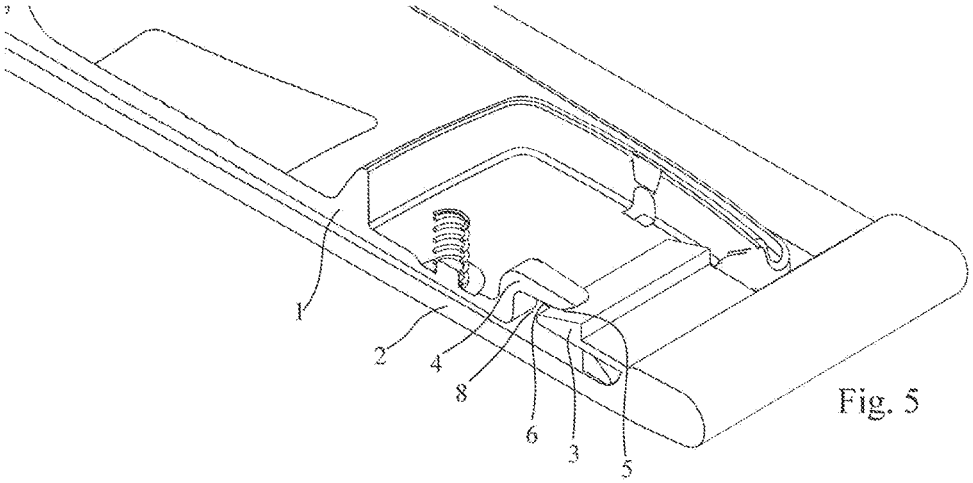
Fig. 5
Fig. 6
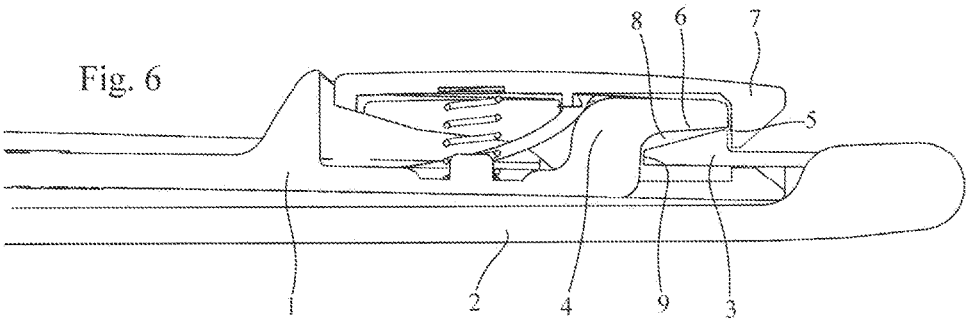

BASE OF A MOP COMPRISING AN ANTI-WITHDRAWAL DEVICE AND A CLEANING CLOTH

CROSS-REFERENCE TO RELATED APPLICATIONS

This application claims the benefit of Italian Patent Application 102018000005169, filed on May 8, 2018, and PCT Application PCT/IB2019/053671, filed on May 6, 2019, both incorporated herein by reference.

STATEMENT REGARDING FEDERALLY SPONSORED RESEARCH AND DEVELOPMENT

Not Applicable.

FIELD OF THE INVENTION

The object of the present invention relates to a device to stop the involuntary detachment of the tabs on a cleaning cloth connected with the relative base, which is able to ensure they remain in place during the relative cleaning operations.

BACKGROUND

The cleaning cloths intended for use with a mop base can be configured in various ways.

They need to perform extremely well, especially the cleaning cloths in the professional cleaning sector.

Limited wear, which can withstand continuous and intense washing, which can remain unchanged even after high temperature wash cycles, which has a great absorption capacity, which can be easily wrung and rinsed, all without compromising the cleaning of the surface that it comes into contact with.

It is obvious that the fibres with which this cleaning cloth is made are specifically purposed to this burdensome task.

However, the cloth alone could not be comfortably used if not properly restrained and kept stretched by a relative support, which is the mop base arranged in a flat manner.

For this reason the connection interface between the actual cleaning cloth and the relative mop base consists of a different material, usually resinous-plastic, welded, glued or sewn to the end of the cloth itself.

Such interfaces generally acquire the form of tabs and are generally referred to using this term.

The tabs are therefore made of a material that is much less flexible than the cloth, with a greater thickness and mass, and which maintain their rectilinear shape in order to be easily inserted into or connected with the various retention systems on the respective bases.

However, it is not possible to use tabs that are too rigid, due to the fact that during washing they could get damaged, and above all, and also, because tabs that are too rigid may not be suitable for the sector of use, coming into contact with furniture or other furnishing elements during cleaning that could get scratched or marked by materials that are too rigid.

The compromise is that of a sufficiently solid tab that can keep its configuration throughout the life of the cloth and that is firmly attached to the relative retention system.

However, as already stated, such cleaning cloths in order to be used in an optimal manner are also tensioned during cleaning, with a tension force that keeps them completely flat both in a wet condition and also in a dry condition on their base.

So the force is generally also overestimated for at least one of the two aforementioned conditions; in fact a cloth generally varies in size going from dry to wet.

As a result of the combination of the tensioning force of the cloth during use, the material used for the tab and the method of fixing the tab to the cloth, it is possible that due to an unexpected and accidental strain during the work, the tab could detach from the relative coupling on the base, becoming free at least at one end the relative connection, or coupling to the base.

This drawback is particularly serious since it occurs precisely in hidden places, out of sight, with entanglements of the cloth beneath furniture, etc. but above all they force the operator to stop to secure the cloth on the base again.

To avoid such an unfortunate accident, which would involve a complete commercial failure, a compromise must be reached with one of the three variables set out above; either a lower tensioning force, or a thinner tab, or a fixing method that does not put any stress on the coupling.

While in order to maintain all the three variables set forth above without any compromise, and therefore to overcome the aforementioned drawbacks without any disadvantages, the invention described below is provided.

SUMMARY OF THE INVENTION

The object of the present invention is to make available an anti-detachment device for a tab for a cleaning cloth connected with each transverse side of the cloth, where said cleaning cloth is held at the respective base on both transverse sides, where said device can overcome all the drawbacks of the prior art set out above.

A different object of the present invention is to make available an anti-detachment device that does not interfere with the cloth retention elements.

A further object of the present invention is to make available an anti-detachment device that can be used in connection with any of the common cleaning cloth tabs.

An important object of the present invention is to provide an anti-detachment device that does not require any maintenance.

Explanation of the Invention

These objects and those which will more clearly be set out in the following description are achieved by a mop base including an anti-detachment device and a cleaning cloth with tabs, where said device for preventing the detachment of a tab of the cloth is connected to the mop base and is fixed to the base configured as a rotated U or an open C, whose lower horizontal rod is fixed solidly to the base and creates a slot-like housing on a transverse side of the cleaning cloth, where said anti-detachment device is; said anti-detachment device is configured as a slot-like housing, for a tab of a cleaning cloth on a transverse side thereof, open at least on the inlet side of the tab, defined as an inlet mouth whose opening, at least around the connection between said device and said tab is slightly larger than the size of said tab, allowing said tab to enter freely and easily into said slit housing through said open side of its mouth, where said rotated U or open C housing overlaps with its upper horizontal rod to at least a limited portion of the extension of the tab along the coupling edge with said mop limiting its relative movements perpendicular to the direction the tab is inserted inside said device.

Eventually the lower horizontal rod of the anti-detachment device configured as a rotated U or an open C is coincident with the plane of the base to which the device is joined and from which the vertical rod departs.

Basically, therefore, said anti-detachment device is configured as a slot inside which at least a part of the tab enters with an insertion movement for coupling to the connection device, and after the entry of a part of the tab within said slot, the anti-detachment device limits the movement of the tab, countering and preventing the tab from moving in a direction orthogonal to that of the insertion, and therefore effectively preventing it from causing the mobile part of the coupling device from lifting up, with the consequent loss of the retention constraint between the tab and the coupling device.

Advantageous Characteristics of the Invention

Advantageously, said anti-detachment device does not interfere with the coupling and detachment system on the mop base when the cleaning cloth is being installed or replaced.

An important advantage of the anti-detachment device lies in the fact that it protects and prevents the tab, when being stretched taut, from being able to open the coupling device on the mop base.

A clear advantage lies in the fact that the coupling device on the base can be dimensioned only to counteract the detachment movements of the tab along the insertion axis, avoiding an oversizing which also takes into account the stresses normal to this direction since they are countered by the anti-detachment device.

A further advantage lies in the fact that said anti-release device has a slot suitable for accommodating each laminar type tab.

Advantageously, said anti-detachment device, on one or both sides of the coupling device, is positioned on both side walls of the coupling device to connect with the side walls of the tab, also constituting a self-centring guide for inserting the tab into the coupling device of the mop base.

Advantageously, said anti-detachment device has a rear wall, opposite to the front opening side, with a closed end stop that constitutes a limit to the frontal part and front end of the tab, defining how far the tab can be inserted within the coupling device.

These and other objects are all attained by the anti-detachment device of the cleaning cloth of the present invention according to the appended claims.

DESCRIPTION OF THE DRAWINGS

The technical characteristics of the invention, according to the aforesaid objects, can clearly be seen in the content of the claims below, and its advantages will become more readily apparent in the detailed description that follows, made with reference to the accompanying drawings, which illustrate a preferred embodiment, which is purely exemplary and not limiting, in which:

FIG. 4 shows, in a perspective view and in an enlarged manner, a part of the transverse end of the base having a cloth shown in FIG. 1; to highlight the anti-detachment device, the object of the invention, the coupling device above has not been drawn.

FIG. 5 shows what is set out in FIG. 4 according to a vertical and longitudinal section plane, highlighting the entry of the tab into the housing of the anti-detachment device.

FIG. 6 shows what has already been set out in FIG. 5 complete with the coupling device, from which it is clear that the anti-detachment device prevents the tab from rising because it is held by the upper wall of the housing into which the tab has penetrated.

DETAILED DESCRIPTION OF THE PREFERRED EMBODIMENT

With reference to the figures, a standard mop base 1 holds a cleaning cloth 2 at its transverse ends in a stretched manner.

This cleaning cloth 2 is of the type that has tabs 3 which guarantee an improved and more convenient connection with the respective coupling devices 7 on the aforesaid base 1.

Figure 1:
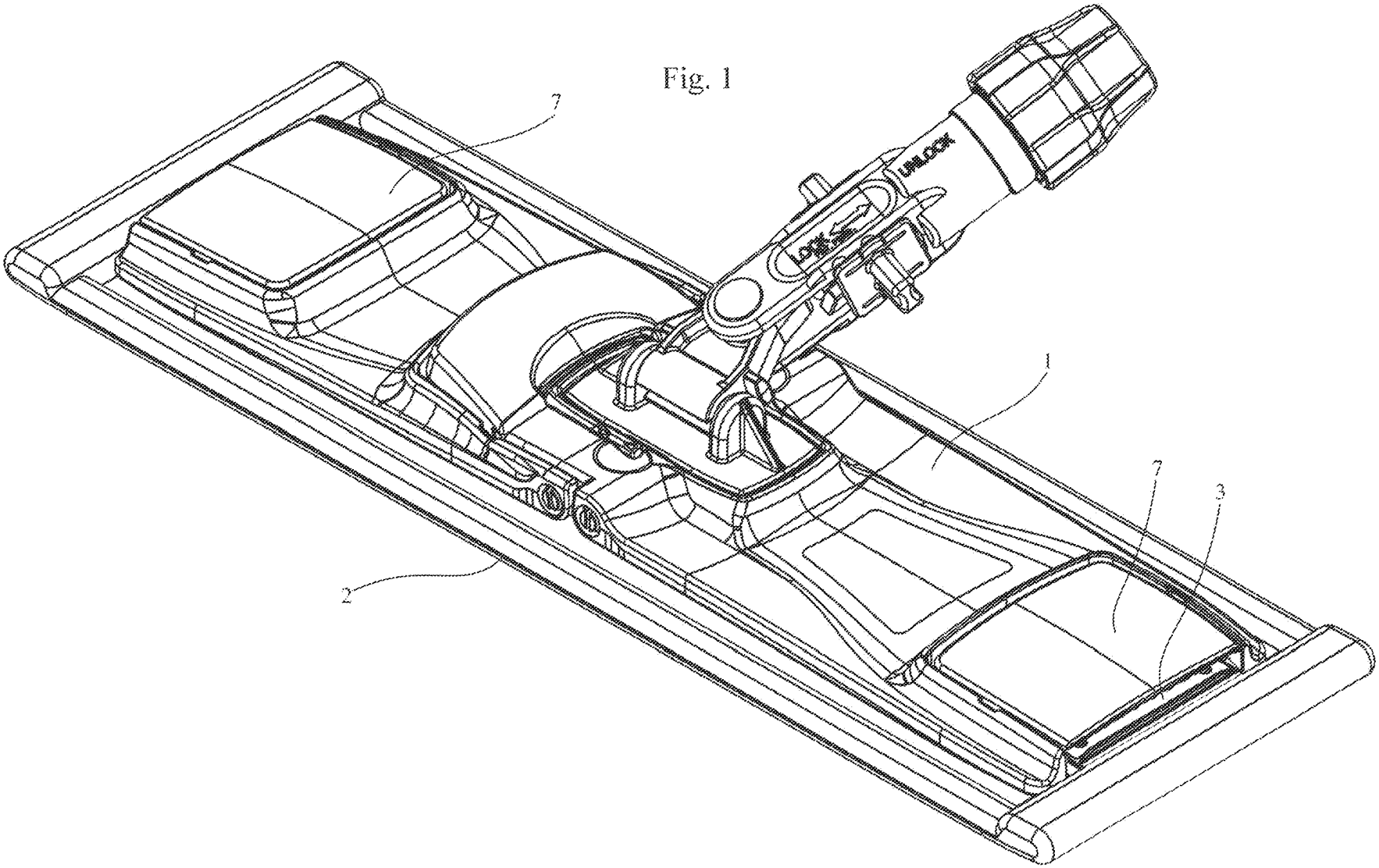
FIG. 1 shows a perspective view of a mop base which holds a cleaning cloth taut beneath it in a level manner. Said cloth is held at its transverse ends by the coupling devices on the mop base.
Figure 2:
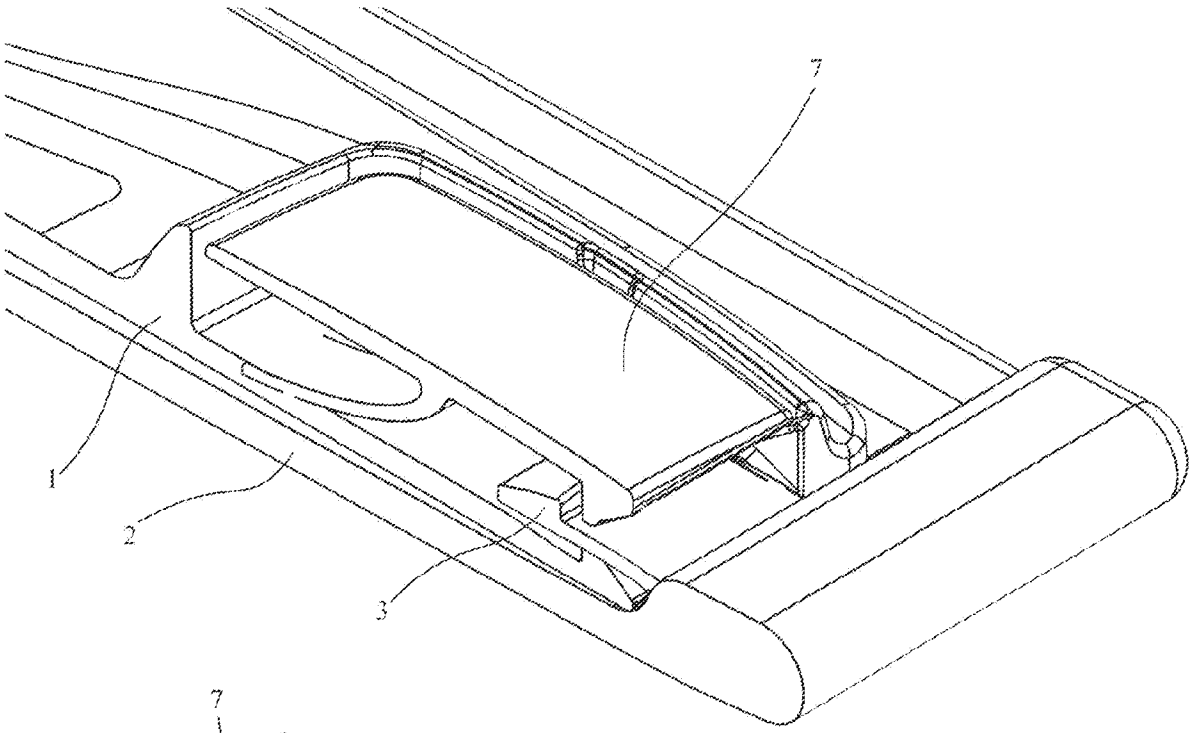
Fig. 2 (Prior Art)
FIG. 2 shows, with a sectional view along a vertical and longitudinal plane, the usual method of retaining a cleaning cloth according to the known art.
Figure 3:
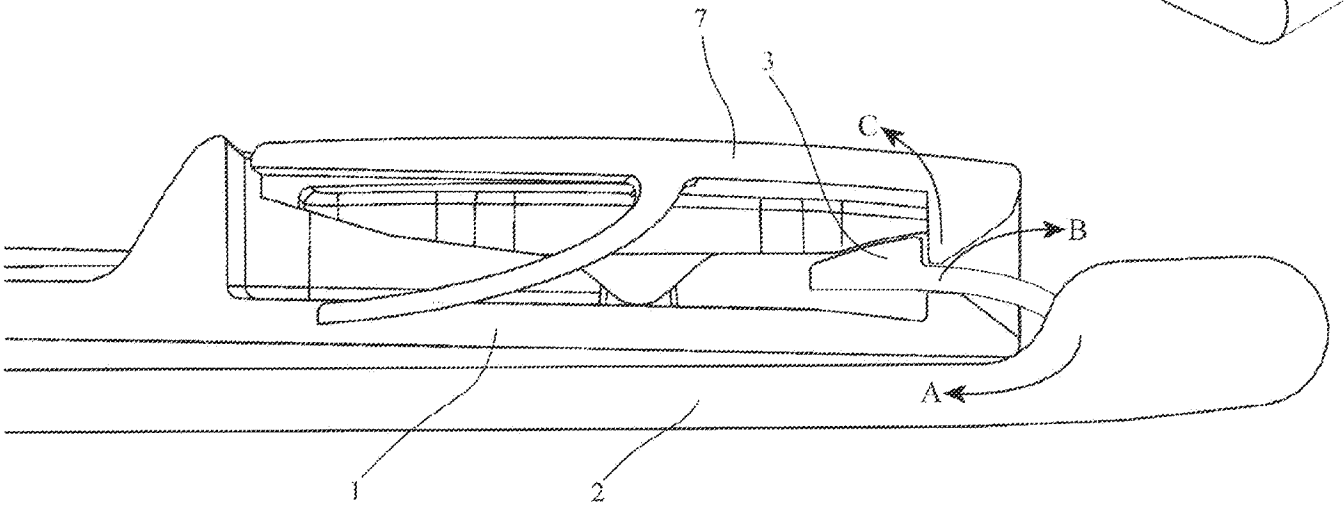
Fig. 3 (Prior Art)
FIG. 3 shows what is set out in FIG. 2 according to a side plan view, clearly showing the various forces and movement tendencies that lead to the extraction of a cloth from the relative base: the state of tension A to which the cloth is subjected, the movement B of the tab, a consequence of the tension A, which causes the raising C of the retention device with the extraction of the cloth from the coupling.

The drawback encountered, as shown in FIGS. 2 and 3, in an embodiment of the known art, consists in the fact that for a multiplicity of factors, excessive tension A of the cloth causes a movement B of the tab 3 which raises up C and undermines the coupling device with the consequent release of the cloth from its detainment.

To overcome this drawback is the purpose of the device of the invention.

This anti-detachment device 4 is configured as a rotated U or an open C, whose lower horizontal rod is solidly connected to the base and whose vertical rod starts from it; while with the upper horizontal rod detached from the base it configures and consists of a housing 8, for at least a portion of the tab, into which the free front part 9 of the tab 3 enters, squeezing in.

In fact said device has an opening 5 to allow the front part of the tab 3 to enter the housing 8.

Said housing is configured as a slender slit, the cavity of which is able to receive said front part 9 of the tab 3.

The upper wall 6 of this housing 8 is capable of countering and retaining an upward movement of the tab 3, generated by the tensioning force to which said tab is subjected during the planar tensioned retention below the base 1.

By preventing the tab from rising, it prevents the tab 3 from accidentally coming into contact and putting undue stress on the coupling device 7 by lifting it and uncoupling it, which would lead to an unacceptable unintended decoupling between the transverse end of the cloth 2 from its connection with the coupling devices 7 on the base 1.

The advantage obtained is also that of being able to size the coupling device 7 to withstand only the stresses of the tab 3 according to an axis coplanar to the tab 3 itself, since the orthogonal stresses are completely countered by the anti-detachment device 4 which prevents the lifting of the tab 3 against the movable element of the coupling device 7.

What is claimed is:

1. A mop base including an anti-detachment device and a cleaning cloth with tabs where said anti-detachment device and at least one of the tabs of the cloth are joined to the mop base and arranged near transverse edges of the base, the anti-detachment device is fixed to the base and is immovable relative to the mop base and configured as a rotated U or open C, a lower horizontal rod of the anti-detachment device is solidly joined to the base and creates a housing with a slot for said tab on a transverse side of the cleaning cloth, the anti-detachment device is open on at least an input side, the anti-detachment device defines an inlet mouth, the inlet mouth defines an opening, at least around a connection between said anti-detachment device and said tab, the opening is open to a side edge of the mop base to provide direct access to a leading edge of the tabs of the cleaning cloth, the opening is greater than a thickness of said tab, allowing said tab to enter into said housing through said open side of the inlet mouth, where said rotated U or open C housing of the anti-detachment device has an upper horizontal rod, where the upper horizontal rod overlaps at least a portion of the tab, to limit relative movements of the tab perpendicular to an insertion direction of the tab inside said anti-detachment device.

2. The mop base of claim 1 wherein the lower horizontal rod of the anti-detachment device configured as said rotated U or open C coincides with a surface of the base to which the anti-detachment device is joined and from where a vertical rod starts.

3. The mop base of claim 1 wherein said anti-detachment device extends for a limited section of said tab and provides for operation of a coupling and detachment system on the mop base during installation or replacement operations.

4. The mop base of claim 1 wherein the opening of the housing of the anti-detachment device is sized to accommodate a laminar tab therein.

5. The mop base of claim 1 wherein said anti-detachment device is positioned on both sides of a coupling device, and wherein said housing is closed at least on one side contiguous to the inlet, allowing said sides to create a stop guide for auto-centering insertion of the tab connecting to side edges of said tab.

6. The mop base of claim 1 wherein said anti-detachment device has a rear wall, opposite to a front opening side, with a closed stop that constitutes a limit to a front part of the tab, thereby defining an extent of the insertion of the tab within a coupling device.

7. The mop base of claim 2 wherein said anti-detachment device extends for a limited section of said tab and provides for operation of a coupling and detachment system on the mop base during installation or replacement operations.

8. The mop base of claim 2 wherein the opening of the housing of the anti-detachment device is sized to accommodate a laminar tab therein.

9. The mop base of claim 2 wherein said anti-detachment device is positioned on both sides of a coupling device, and wherein said housing is closed at least on one side contiguous to the inlet, allowing said sides to create a stop guide for auto-centering insertion of the tab connecting to side edges of said tab.

10. The mop base of claim 2 wherein said anti-detachment device has a rear wall, opposite to a front opening side, with a closed stop that constitutes a limit to a front part of the tab, thereby defining an extent of the insertion of the tab within a coupling device.

11. A mop base comprising:

a base lower surface configured to have a cleaning cloth attached thereto for cleaning;

a base upper surface opposite the base lower surface;

a first side and a second side, opposite the first side, the first and second sides connecting the base lower surface with the base upper surface; and a first anti-detachment member comprising:

a first support member extending upward from the base upper surface in a direction away from the base upper surface and the base lower surface, the first support member terminating at a first distal end; and a first extension member extending outward from the first distal end toward the first side, spaced apart a first predetermined distance from the base upper surface; and a coupling and detachment system having an arm resiliently urged toward the base upper surface between the first anti-detachment member and the first side.

12. The mop base of claim 11, further comprising: a second anti-detachment member comprising: a second support member extending upward from the base upper surface in the direction away from the base upper surface and the base lower surface, the second support member terminating at a second distal end; and a second extension member extending outward from the second distal end toward the second side, spaced apart a second predetermined distance from the base upper surface.

13. The mop base of claim 12, wherein the first anti-detachment member is spaced away from the first side a first distance and the second anti-detachment member is spaced away from the second side a second distance, the first distance being equal to the second distance.

14. The mop base of claim 11, where the first predetermined distance is sized to receive a tab of a cleaning cloth therein when said cleaning cloth is attached to the mop base.

15. The mop base of claim 11, wherein the arm has a surface perpendicular to a plane of the base upper surface.

16. A cleaning apparatus comprising:

a mop base comprising:

a base lower surface;

a base upper surface opposite the base lower surface;

a first side and a second side, opposite the first side, the first and second sides connecting the base lower surface with the base upper surface; and a first anti-detachment member comprising: a first support member extending upward from the base upper surface in a direction away from the base upper surface and the base lower surface, the first support member terminating at a first distal end; and a first extension member extending outward from the first distal end toward the first side, spaced apart a first predetermined distance from the base upper surface;

a coupling and detachment system having an arm resiliently urged toward the base upper surface between the first anti-detachment member and the first side, and a cleaning cloth comprising: a cleaning cloth upper surface removably disposed against the base lower surface; a first tab on a first side of the cleaning cloth, the first tab at least partially insertable into the first anti-detachment member, between the first extension member and the base upper surface, when the cleaning cloth is disposed on the mop base.

17. The cleaning apparatus of claim 16, further comprising: a second anti-detachment member comprising: a second support member extending upward from the base upper surface in the direction away from the base upper surface and the base lower surface, the second support member terminating at a second distal end; and a second extension member extending outward from the second distal end toward the second side, spaced apart a second predetermined distance from the base upper surface, wherein the cleaning cloth further comprises a second tab on a second side of the cleaning cloth, the second tab at least partially insertable into the second anti-detachment member, between the second extension member and the base upper surface, when the cleaning cloth is disposed on the mop base.

18. The cleaning apparatus of claim 16, where the first predetermined distance is greater than a thickness of the first tab of the cleaning cloth.

* * * * *